US008009807B2

(12) United States Patent
Petrik

(10) Patent No.: US 8,009,807 B2
(45) Date of Patent: Aug. 30, 2011

(54) RADIATION SCREEN FOR AN X-RAY DEVICE

(75) Inventor: Robert Petrik, Friedenfels (DE)

(73) Assignee: Siemens Aktiengesellschaft, Munich (DE)

( * ) Notice: Subject to any disclaimer, the term of this patent is extended or adjusted under 35 U.S.C. 154(b) by 127 days.

(21) Appl. No.: 11/795,230

(22) PCT Filed: Jun. 12, 2006

(86) PCT No.: PCT/EP2006/063093
§ 371 (c)(1),
(2), (4) Date: Jul. 13, 2007

(87) PCT Pub. No.: WO2006/134087
PCT Pub. Date: Dec. 21, 2006

(65) Prior Publication Data

US 2008/0101545 A1 May 1, 2008

(30) Foreign Application Priority Data

Jun. 17, 2005 (DE) ..... 10 2005 028 208

(51) Int. Cl.
*G21K 1/04* (2006.01)
*G21K 1/02* (2006.01)

(52) U.S. Cl. ..... 378/148; 378/149; 378/150; 378/151

(58) Field of Classification Search ..... 378/147–151, 378/156–158, 160
See application file for complete search history.

(56) References Cited

U.S. PATENT DOCUMENTS 2,591,536 A 4/1952 Gieringer et al.
4,241,404 A * 12/1980 Lux ..... 378/2
4,773,087 A 9/1988 Plewes
5,086,444 A * 2/1992 Bartmann ..... 378/152
5,107,529 A * 4/1992 Boone ..... 378/157
5,396,889 A * 3/1995 Ueda et al. ..... 600/407
6,292,532 B1 9/2001 Kawahara et al.
6,292,632 B1 9/2001 Zander et al.
6,968,040 B2 * 11/2005 Van Woezik ..... 378/147
7,132,674 B2 * 11/2006 Pastyr et al. ..... 250/505.1
2001/0053199 A1 * 12/2001 Sundermann et al. ..... 378/147
2005/0141671 A1 * 6/2005 Pastyr et al. ..... 378/148

FOREIGN PATENT DOCUMENTS

BE 100 933 2/1997

(Continued)

OTHER PUBLICATIONS

EPO Machine Translation in English for International Patent Application Publication WO 03/043698 A1 (May 30, 2003).*

(Continued)

*Primary Examiner* — Anastasia Midkiff
(74) *Attorney, Agent, or Firm* — Lempia Summerfield Katz LLC

(57) ABSTRACT

The invention relates to a radiation screen for an X-ray device, comprising at least one radiation limiting means which is displaceably mounted and is embodied as a diaphragm. According to the invention, the radiation limiting means is displaceably mounted on a plane in a perpendicular manner in relation to a defining bundle of rays, and comprises a plurality of differently shaped diaphragm apertures for continuously limiting the different bundle of rays. It can, for example, be embodied as an essentially rotation-symmetrical perforated disk. In another embodiment, the radiation screen comprises two radiation defining means which are arranged in an overlapping manner in the direction of the bundle of rays which are to be defined.

18 Claims, 4 Drawing Sheets

FOREIGN PATENT DOCUMENTS

| | | | |
|---|---|---|---|
| DE | 81 18 153 | U1 | 1/1985 |
| EP | 0 485 742 | A1 | 10/1991 |
| EP | 0 462 658 | A2 | 12/1991 |
| EP | 0 565 069 | A1 | 10/1993 |
| EP | 0 632 995 | A1 | 1/1995 |
| GB | 1 512 441 | | 6/1978 |
| WO | WO 03043698 | A1 * | 5/2003 |

OTHER PUBLICATIONS

International Search Report for Application No. PCT/EP2006/063093.
Written Opinion for Application No. PCT/EP2006/063093 (in both English and German).
German Office Action dated Jul. 30, 2007 with English translation.

* cited by examiner

RADIATION SCREEN FOR AN X-RAY DEVICE

The present patent document is a nationalization of PCT Application Serial Number PCT/EP2006/063093, filed Jun. 12, 2006, designating the United States, which is hereby incorporated by reference. This application also claims the benefit of DE 10 2005 028 208.3, filed Jun. 17, 2005, which is hereby incorporated by reference.

BACKGROUND

The present embodiments relate to a radiation diaphragm for an x-ray facility and an x-ray facility with such a radiation diaphragm.

Radiation diaphragms are used in x-ray facilities to narrow an x-ray beam produced by an x-ray tube to form a useful beam. Regions outside the useful beam are masked out by the radiation diaphragm, so that the radiation diaphragm's form decides the residual contour of the useful beam. It is expedient to vary the contour as a function of the respective task. When examining patients or bodies, the aim is to achieve a contour of the useful beam that is tailored to the volume to be examined, to avoid exposing the surrounding region to an unnecessary radiation dose.

Radiation diaphragms disposed in the immediate proximity of the x-ray tube are also referred to as primary radiation diaphragms. Primary radiation diaphragms frequently have a number of individual diaphragms, disposed at different distances from the x-ray tube. The x-ray beam is initially roughly narrowed by a diaphragm disposed first in the beam path, sometimes referred to as a collimator, which brings about an approximately rectangular definition of the beam by one or two pairs of diaphragm plates. Finer definition of the beam path, the contour of which is not necessarily set as rectangular in form, then takes place by a similarly adjustable diaphragm disposed in the beam path.

EP 0 485 742 discloses a further diaphragm that can be embodied as an iris diaphragm. Generally, iris diaphragms produce an approximately circular definition of the x-ray beam. The diameter or typical size of the x-ray beam can be adjusted extremely finely, usually in a continuous manner. Iris diaphragms have a relatively large number of moving parts. Iris diaphragms are complex to construct and expensive to produce. Iris diaphragms have louvers, which are mounted in a displaceable manner and bring about the actual masking of regions of the x-ray beam that are not of interest. The louvers themselves and also their mounting are susceptible to damage due to the louver movement.

BE 100 9333 discloses a radiation diaphragm for a portable x-ray facility. The radiation diaphragm is designed as a perforated diaphragm. The radiation diaphragm has a radiation defining device, formed as a cylinder and disposed concentrically in relation to the x-ray tube. The radiation diaphragm has a plurality of diaphragm apertures, each being able to be positioned by rotating the radiation defining means in front of the beam emission window. The cylindrical form of the radiation defining means has to be tailored to the x-ray tube, around which it is disposed. The radiation defining means cannot be disposed freely but requires an arrangement that is concentric to the x-ray tube. This arrangement requires a complex rotational mounting, since the x-ray tube is disposed in the center of the radiation defining means, where a rotation axis should advantageously be disposed.

SUMMARY

The present embodiments may obviate one or more of the drawbacks or limitations inherent in the related art. A radiation diaphragm allows fine adjustment of the contour of the useful beam, but which is at the same time simple to construct and economical to produce. An x-ray facility may have such a radiation diaphragm.

In one embodiment, a radiation diaphragm includes at least one radiation defining device mounted in a displaceable manner. The radiation diaphragm is embodied as a perforated diaphragm, which is mounted in a displaceable manner in a plane perpendicular to a beam to be limited, and which has a plurality of differently formed diaphragm apertures for the respectively differently contoured definition of the beam. The arrangement and mounting of the radiation defining device is independent to the greatest possible extent of the form and position of the x-ray tube producing the beam. The form and mounting can be designed as simply as possible, thereby also keeping production costs low. A perforated diaphragm can also be produced particularly simply, compared with an iris diaphragm.

In one embodiment, the radiation defining device is mounted in a rotatable manner in the plane perpendicular to the beam. A rotational mounting can, for example, be realized with little outlay in the form of a simple rotation axis. Rotational movement can be driven and controlled in a simple manner.

In one embodiment, the radiation defining device is a perforated disk with a round periphery. The space requirement of a circular disk is small, in particular during rotational movement of the circular disk.

In one embodiment, the radiation diaphragm has at least two radiation defining devices. The at least two radiation defining devices are disposed in a mutually overlapping manner in the direction of the beam. The required, differently formed diaphragm apertures can be distributed over more than one radiation defining device. This allows a space-saving arrangement of the diaphragm apertures on the respective radiation defining device, so that a smaller periphery results, in particular in the case of the round radiation defining device, and the overall surface can be utilized in a more optimum manner. To double the number of diaphragm apertures, which have to be disposed on an identical radius of a round perforated disk, it would be necessary approximately to double the perforated disk radius (because circumference=$2*\pi*r$), with the surface content of the perforated disk however being quadrupled (because surface=$\pi*r^2$). However, if the double number of diaphragm apertures is distributed over two perforated disks, there is only a doubling of the overall surface of the perforated disks. The radiation defining devices are disposed in an overlapping manner, thereby reducing their overall surface extension by the sum of the mutual overlap.

In one embodiment, the radiation defining devices disposed in a mutually overlapping manner has at least two diaphragm apertures, each being able to be disposed completely within the periphery of at least one diaphragm aperture of the other radiation defining device. The diaphragm apertures can be positioned so that the beam passes through a diaphragm aperture of each radiation defining device and gives the greatest possible diversity of variation for the contours of the defined beam to be achieved.

DETAILED DESCRIPTION

Figure 1:
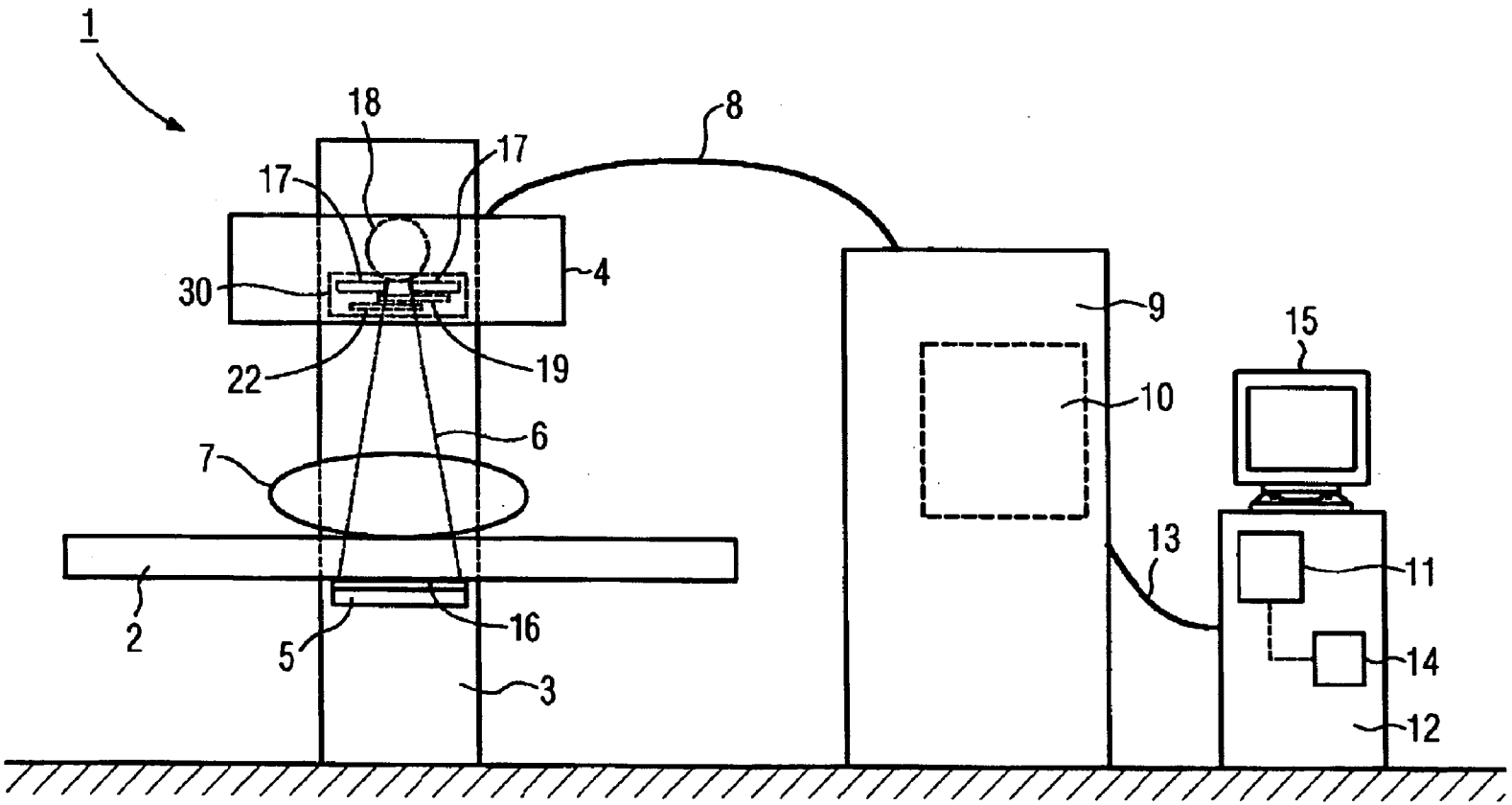
FIG. 1 illustrates an x-ray facility with radiation diaphragm.

FIG. 1 shows a schematic diagram of an x-ray facility 1 with a radiation diaphragm 30. A patient to be examined 7 is supported on a patient bed 2. Below the patient bed 2 is an image receiver 5 along with associated scattered radiation grids 16 for recording x-ray images. The patient bed 2 is attached to a gantry 3. An x-ray radiation source 4 is attached to the gantry 3. The x-ray radiation source 4 has an x-ray tube 18 for producing x-ray radiation and a (conventional) primary diaphragm 17 for rough definition of the x-ray beam 6. The primary diaphragm 17 has two diaphragm plates, allowing an essentially right-angled definition. After passing through the primary diaphragm 17, the x-ray beam 6 is defined further to the required contour by the perforated disks 19 and 22, which together form a space-saving and structurally simple second radiation diaphragm. It is possible to achieve contours that are not rectangular and to set a number of dimensions for the contour. The primary diaphragm 17 and the second diaphragm formed by the perforated disks 19 and 22 together form the radiation diaphragm 30.

The x-ray radiation source 4 and radiation diaphragm 30 are supplied with the necessary operating voltage and control signals by a supply line 8. The necessary electrical signals are supplied by a switchgear cabinet 9, which has a high voltage generator 10 that generates the x-ray voltage required to operate the x-ray tube 18 in addition to switching means (not shown) for generating the control signals. The switchgear cabinet 9 is connected by way of a data cable 13 to a control facility 12. The switchgear cabinet 9 is controlled by the control facility 12. The control facility 12 has a display device 15, at which current operating data and parameter settings can be displayed. A data processing facility 11 processes operator inputs, supplies preset x-ray programs for predefined recording situations, and generates the control signals for the switchgear cabinet 9. The data processing facility 11 accesses a diaphragm memory 14, which has information for adjusting the second diaphragm formed by the perforated disks 19 and 22. The diaphragm memory 14 has information, based on which, when an operator or x-ray program selects a required contour for the x-ray beam 6, the setting for the respective perforated disk 19, 22 is determined, which allows the selected contour to be best achieved.

Figure 2:
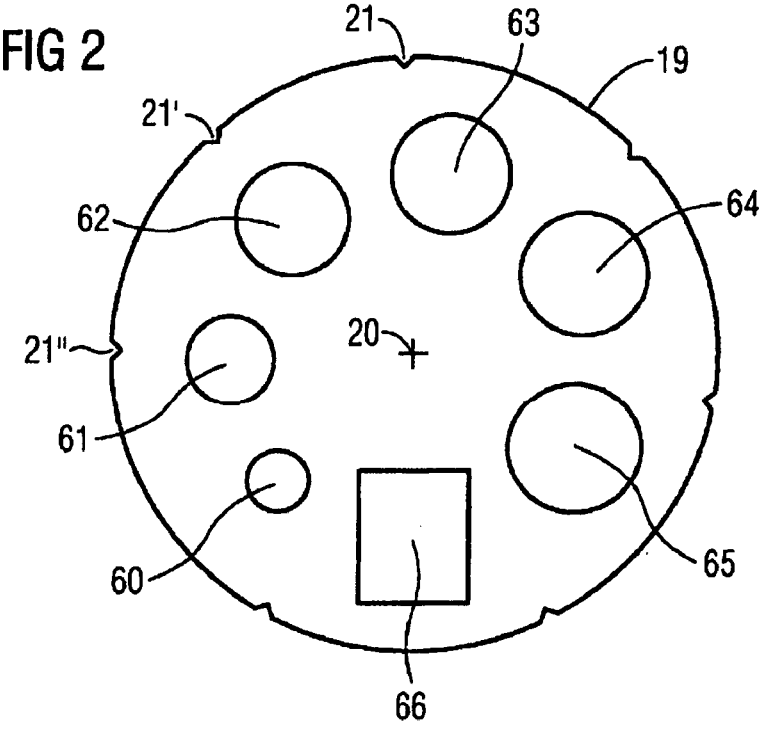
FIG. 2 illustrates a first flat disk of the radiation diaphragm.

As shown in FIG. 2, the first perforated disk 19 of the second diaphragm includes a circular periphery and is mounted in a rotatable manner in a centrally disposed axis support 20. The first perforated disk 19 of the second diaphragm can be installed in a simple manner within the radiation diaphragm 30 using the axis support 20.

The first perforated disk 19 of the second diaphragm includes a plurality of diaphragm apertures 60, 61, . . . , 66 of differing forms and sizes, allowing diverse contouring of an x-ray beam. The first perforated disk 19 is made from a material that does not allow the passage of x-ray radiation, for example, lead or another element with a high atomic number, so that a passing x-ray beam is blocked by the perforated disk 19 and can only pass through a respective diaphragm aperture 60, . . . , 66. The diaphragm aperture 60, . . . , 66 is simply be positioned in the x-ray beam.

The differing forms and sizes of the diaphragm apertures 60, . . . , 66 are only shown schematically. The round apertures can, for example, have a respective diameter of 10 mm, 14 mm, 18 mm, 19 mm, 20 mm and 21 mm. Other individual sizes can similarly be realized. The first perforated disk 19 of the second diaphragm includes a rectangular diaphragm aperture 66. The form and size of the rectangular diaphragm aperture 66 are tailored to an x-ray film cassette in such a manner that this can be fully exposed by the x-ray radiation defined using the rectangular diaphragm aperture 66. To allow precise positioning of a respective diaphragm aperture 60, . . . , 66 as controlled by positioning facilities, positioning marks 21, 21', 21", . . . are provided on the periphery of the perforated disk 19. The position of each positioning mark 21, 21', 21", . . . correlates to the position of a respective diaphragm aperture 60, . . . , 66. The positioning marks 21, 21', 21", . . . enclose the same midpoint angles or arcs as the positions of the diaphragm apertures 60, . . . , 66. A specific position of a respective positioning mark 21, 21', 21", . . . corresponds to a specific position of the respectively associated diaphragm aperture 60, . . . , 66. This allows precise machine positioning.

Figure 3:
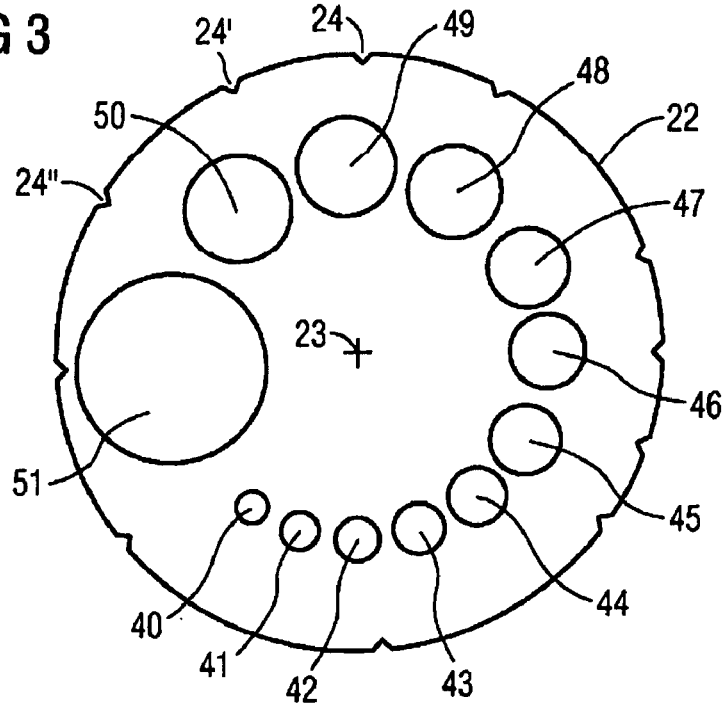
FIG. 3 illustrates a second perforated disk of radiation diaphragm.

As shown in FIG. 3, the second perforated disk 22 is embodied in a similar manner to the first perforated disk 19 described above in FIG. 2 and can also be mounted in a rotatable manner in a central axis support 23. The second perforated disk 22 has a plurality of diaphragm apertures 40, . . . , 51 in differing sizes and positioning marks 24, 24', 24", . . . that correlate to the respective position. The individual sizes of the diaphragm apertures 40, . . . , 51 are shown schematically and can have diameters, for example, from 5 mm to 16 mm in 1 mm steps and can have a diameter of 30 mm for the largest diaphragm aperture 51.

Figure 4:
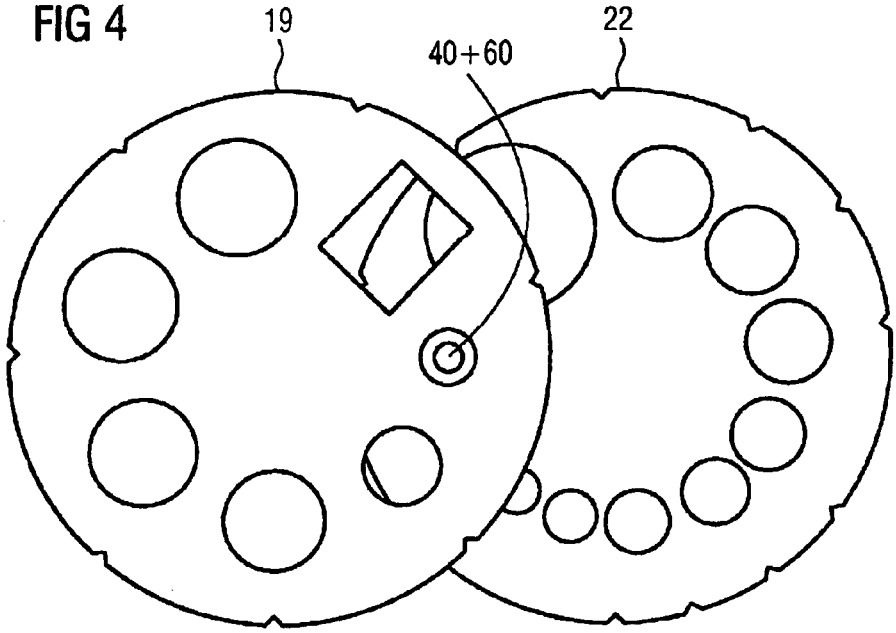
FIG. 4 illustrates a mutually overlapping arrangement of the perforated disks to achieve a first diaphragm aperture.

FIG. 4 shows a schematic top view of the interaction of the perforated disks 19 and 22, which are disposed in a mutually overlapping manner in the direction of the beam path in the radiation diaphragm 30. The perforated disks 19 and 22 should be disposed in the beam so that the midpoint of the mutual overlap of the two disks is disposed in the midpoint of the beam. In the rotation position shown in FIG. 4 the diaphragm aperture 60 of the perforated disk 19 and the diaphragm aperture 40 of the perforated disk 22 are positioned at the midpoint of the mutual overlap of the two disks. Since the diaphragm aperture 40 has the smaller diameter, it predetermines the contour and diameter of the x-ray radiation beam passing through it. The diaphragm aperture 40 is significance to the diaphragm setting actually achieved. In the embodiment of the perforated disks shown, the diaphragm apertures 41, 42, 43 and 44 of the perforated disk 22 have smaller diameters than the diaphragm aperture 60 of the perforated disk 19. With concentric positioning with the diaphragm aperture 60, the diaphragm apertures 41, 42, 43 and 44 of the perforated disk 22 would be respectively determining factors in respect of the effective diaphragm setting.

Figure 5:
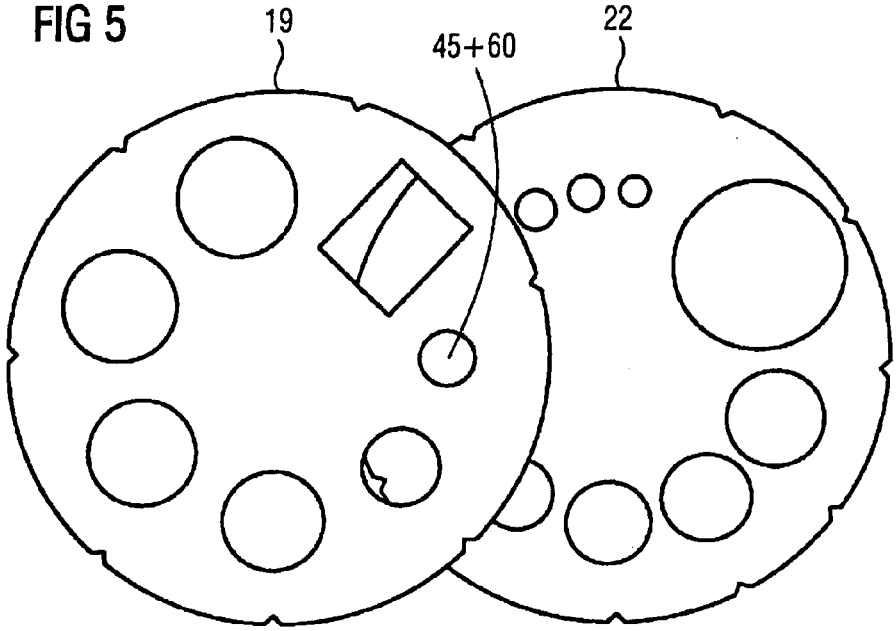
FIG. 5 illustrates a mutually overlapping arrangement of the perforated disks to achieve a second diaphragm aperture.

FIG. 5 shows a positioning of the perforated disks 19 and 22. The diaphragm aperture 45 of the perforated disk 22 and the diaphragm aperture 60 of the perforated disk 19 are disposed at the midpoint of the overlap. The diaphragm aperture 60 has a smaller diameter compared with the diaphragm aperture 45 and is a determining factor for the x-ray beam passing through it. The diaphragm aperture 60 represents the effective diaphragm setting.

Figure 6:
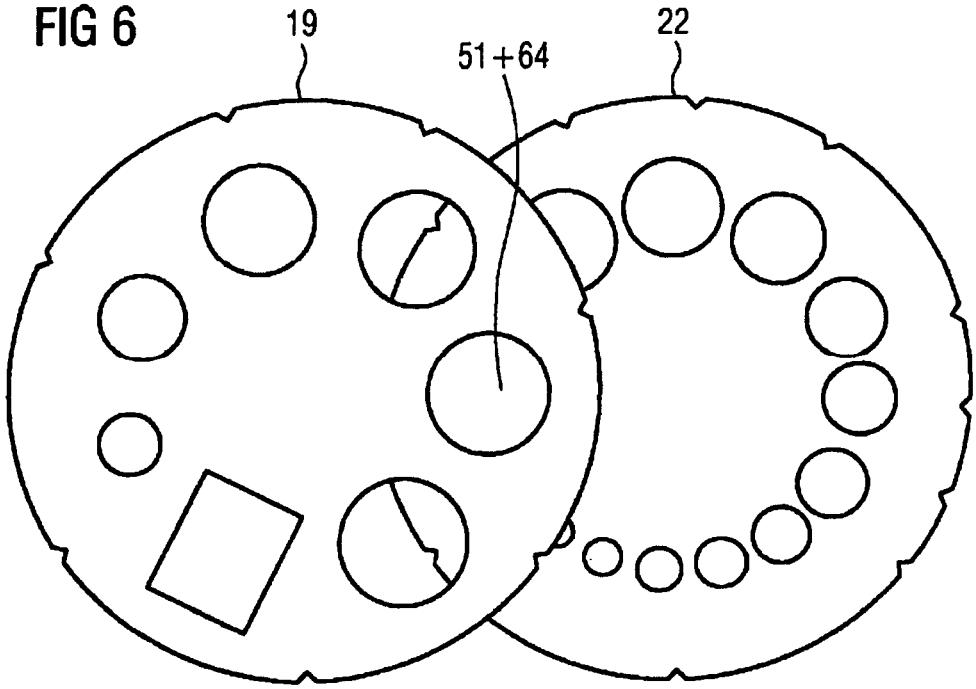
FIG. 6 illustrates a mutually overlapping arrangement of the perforated disks to achieve a third diaphragm aperture

FIG. 6 shows a further positioning of the perforated disks 19 and 22. The diaphragm apertures 51 and 64 are positioned at the midpoint of the x-ray beam. Because of its comparatively small diameter, the diaphragm aperture 64 is a determining factor for the effective diaphragm setting.

Figure 7:
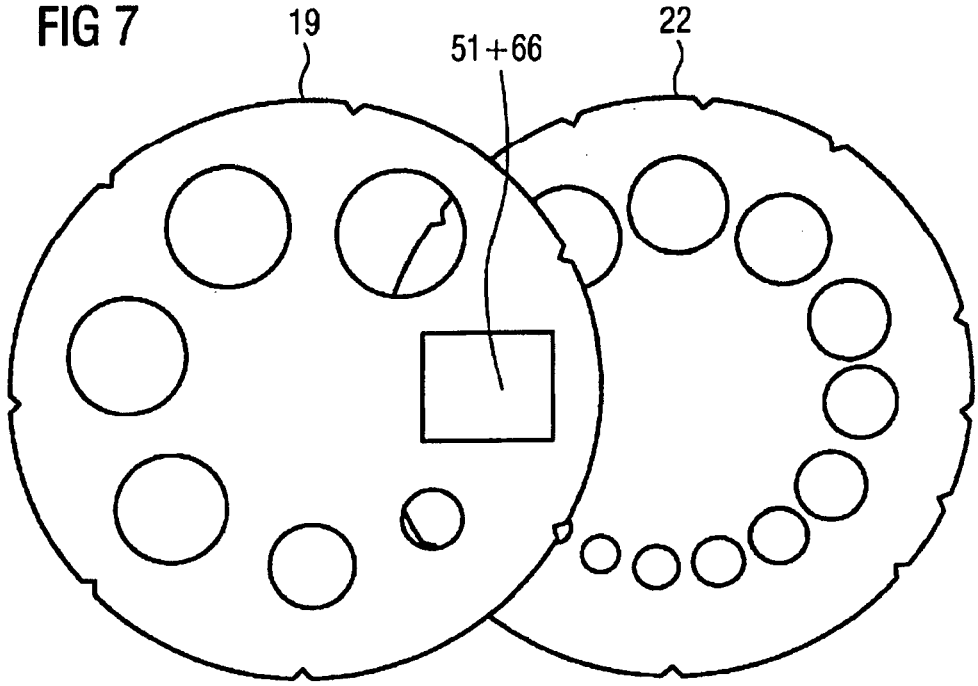
FIG. 7 illustrates a mutually overlapping arrangement of the perforated disks to achieve a fourth diaphragm aperture.

FIG. 7 shows a further positioning of the perforated disks 19 and 22. The diaphragm apertures 51 and 66 are positioned at the midpoint of the x-ray beam. The rectangular diaphragm aperture 66, the contour and dimensions of which can, for example, be matched to an x-ray film cassette to be exposed, is disposed completely within the periphery of the diaphragm aperture 51 and has smaller dimensions than the diaphragm aperture 51. The rectangular diaphragm aperture 66 is a determining factor for the effective diaphragm setting.

As shown in FIGS. 4 to 7 and described above, the selected distribution of the diaphragm sizes over the two perforated disks 19 and 22 and their mutual overlap allows an extremely compact structure of the diaphragm. The diaphragm ensures a wide diversity of variation of the possible effective diaphragm settings. The relatively dense arrangement of the diaphragm apertures 40, . . . , 51, 60, . . . , 66 on the respective perforated disks 19 and 22 in particular is clear, allowing efficient utilization of the respective perforated disk surface.

The present embodiments relate to a radiation diaphragm 30 for an x-ray facility 1 with at least one radiation defining element, which is mounted in a displaceable manner and embodied as a perforated disk. The radiation defining element is mounted in a displaceable manner in a plane perpendicular to a beam to be defined 6 and has a plurality of differently formed diaphragm apertures 40, . . . 51, 60, . . . 66 for respectively differently contoured definition of the beam 6. The radiation defining element can, for example, be embodied as an essentially rotationally symmetrical perforated disk. In one embodiment, there are two radiation defining elements, which are disposed in a mutually overlapping manner in the direction of the beam to be defined 6.

Various embodiments described herein can be used alone or in combination with one another. The forgoing detailed description has described only a few of the many possible implementations of the present invention. For this reason, this detailed description is intended by way of illustration, and not by way of limitation. It is only the following claims, including all equivalents that are intended to define the scope of this invention.

The invention claimed is:

1. A radiation diaphragm operative to narrow an x-ray beam produced by an x-ray tube of an x-ray facility to form a narrowed beam and to mask out regions outside the narrowed beam, the radiation diaphragm comprising:

at least two radiation defining devices, wherein the at least two radiation defining devices are mounted on different central axis supports in a displaceable manner in planes perpendicular to the x-ray beam, and each of the at least two radiation defining devices includes a plurality of different diaphragm apertures with different shapes for differently contoured definition of the x-ray beam, wherein the plurality of different diaphragm apertures adjust the contour of the narrowed beam, and wherein each diaphragm aperture of one of the at least two radiation defining devices is disposable within the periphery of at least one diaphragm aperture of another of the at least two radiation defining devices.

2. The radiation diaphragm as claimed in claim 1, wherein each of the at least two radiation defining devices extends in an essentially flat manner.

3. The radiation diaphragm as claimed in claim 1, wherein each of the at least two radiation defining devices is mounted in a rotatable manner in one of the planes perpendicular to the x-ray beam.

4. The radiation diaphragm as claimed in claim 1, wherein each of the at least two radiation defining devices is a perforated disk.

5. The radiation diaphragm as claimed in claim 4, wherein the perforated disk includes a round periphery.

6. The radiation diaphragm as claimed in claim 1, wherein each of the at least two radiation defining devices has positioning marks that are disposed so that the radiation defining device is positionable based on a position of the radiation defining device such that a respective diaphragm aperture is disposed in the x-ray beam.

7. The radiation diaphragm as claimed in claim 6, wherein the positioning marks are disposed on a round periphery of the perforated disk.

8. The radiation diaphragm as claimed in claim 7, wherein each of the at least two radiation defining devices is disposed so that the x-ray beam passes through one diaphragm aperture of each of the at least two radiation defining devices.

9. An x-ray facility comprising:

at least two radiation diaphragms that include a plurality of different diaphragm apertures, the plurality of different diaphragm apertures operable to define a shaped beam in different contours, wherein each of the at least two radiation diaphragms is displaceable in a plane perpendicular to the shaped beam, wherein each of the at least two radiation diaphragms is operative to narrow an x-ray beam produced by an x-ray tube of the x-ray facility to form the shaped beam and to mask out regions outside the shaped beam, wherein the at least two radiation diaphragms are mounted on different central axis supports, wherein the plurality of different diaphragm apertures adjust the contour of the shaped beam, and wherein each diaphragm aperture of one of the at least two radiation diaphragms is disposable within the periphery of at least one diaphragm aperture of another of the at least two radiation diaphragms.

10. The x-ray facility as claimed in claim 9, wherein each of the at least two radiation diaphragms includes a first perforated radiation defining device that includes at least one aperture, and a second perforated radiation defining device that includes at least one aperture, and wherein the first perforated radiation defining device and the second perforated radiation defining device are operative to be moved to provide different contours of the shaped beam.

11. The x-ray facility as claimed in claim 10, comprising: a data processing facility and a diaphragm memory that includes data, wherein the data processing facility has access to the diaphragm memory and the diaphragm memory data, the data processing facility being operable to determine a position of at least one of the first perforated radiation defining device and the second perforated radiation defining device.

12. The x-ray facility as claimed in claim 11, wherein the data processing facility is connected to each of the at least two radiation diaphragms and is operable to control the positioning of at least one of the first perforated radiation defining device and the second perforated radiation defining device in a suitable position.

13. The x-ray facility as claimed in claim 10, wherein the first perforated radiation defining device and the second perforated radiation defining device include a circular periphery.

14. The x-ray facility as claimed in claim 11, wherein the data processing facility is operable to determine the position based on the diaphragm memory data.

15. The radiation diaphragm as claimed in claim 1, wherein the plurality of different diaphragm apertures comprises openings with different diameters.

16. The x-ray facility as claimed in claim 9, wherein the plurality of different diaphragm apertures comprises openings with different diameters.

17. The radiation diaphragm as claimed in claim 14, wherein the first perforated radiation defining device and the second perforated radiation defining device have different aperture patterns.

18. The radiation diaphragm as claimed in claim 1, wherein the plurality of different diaphragm apertures are open spaces that do not contain any material.

* * * * *